US007055813B2

(12) United States Patent
Hexamer, Jr.

(10) Patent No.: US 7,055,813 B2
(45) Date of Patent: Jun. 6, 2006

(54) VISE MATE

(76) Inventor: Vearl Patrick Hexamer, Jr., 6067 S. 50 East, Anderson, IN (US) 46013-9503

( * ) Notice: Subject to any disclaimer, the term of this patent is extended or adjusted under 35 U.S.C. 154(b) by 0 days.

(21) Appl. No.: 10/839,483

(22) Filed: May 5, 2004

(65) Prior Publication Data

US 2004/0222580 A1 Nov. 11, 2004

Related U.S. Application Data

(60) Provisional application No. 60/468,549, filed on May 7, 2003.

(51) Int. Cl.
*B25B 1/24* (2006.01)

(52) U.S. Cl. ..... 269/277; 269/285; 269/286

(58) Field of Classification Search ..... 269/277, 269/278, 285, 286
See application file for complete search history.

(56) References Cited

U.S. PATENT DOCUMENTS

| | | | | |
|---|---|---|---|---|
| 81,764 | A | | 8/1868 | Fisher |
| 99,626 | A | | 2/1870 | Bergh |
| 530,733 | A | | 12/1894 | Tower |
| 800,685 | A | | 10/1905 | Scoggins |
| 1,025,739 | A | * | 5/1912 | Davis ..... 269/277 |
| 2,378,543 | A | | 6/1945 | Fest |
| 2,606,470 | A | | 8/1952 | Kinney |
| 3,502,319 | A | | 3/1970 | Kazolias |
| 4,078,782 | A | | 3/1978 | Carlson |
| 4,422,629 | A | | 12/1983 | Carlson |
| 4,437,654 | A | | 3/1984 | Chiappetti |
| D292,481 | S | * | 10/1987 | Wolff ..... D8/74 |
| 6,170,813 | B1 | | 1/2001 | Bowers |

* cited by examiner

*Primary Examiner*—Robert C. Watson
(74) *Attorney, Agent, or Firm*—Ritchison Law Offices, PC; John D. Ritchison

(57) ABSTRACT

An auxiliary mechanism for a vise called a Vise Mate. This device features extender jaws to enable a person to hold larger than normal objects in a common shop vise. These extender jaws featured with a stabilizer bar permit a person to quickly expand the physical capacity of the shop vise with only the auxiliary vise mate and no additional set-up tools.

2 Claims, 7 Drawing Sheets

Fig. 4A – TOP VIEW

Fig. 4B – FRONT VIEW

Fig. 4C – END VIEW

Fig. 4D Section A-A

Fig. 6B - Section B - B

Fig. 6A – Bottom View

Fig. 7A - Open Position without Jaws

Fig. 7B – Closed Position with Jaws

Fig. 7C - Open Position with Jaws

VISE MATE

CROSS-REFERENCE TO RELATED APPLICATIONS

This application claims the benefit of Provisional Patent Application Ser. No. 60/468,549 filed May 7, 2003 by Vearl Patrick Hexamer, Jr. and titled "VISE MATE".

FIELD OF INVENTION

The present device relates to the field of auxiliary mechanisms for a vise called a Vise Mate. This device features extender jaws to enable a person to hold larger than normal objects in a common shop vise. These extender jaws, featured with a stabilizing bar, permit a person to quickly expand the physical capacity of the shop vise with only the auxiliary vise mate and with no additional set-up tools.

FEDERALLY SPONSORED RESEARCH

Not Applicable.

SEQUENCE LISTING OR PROGRAM

Not Applicable

BACKGROUND

Field of Invention

The new Vise Mate described in this specification is an auxiliary mechanism that is designed to easily and quickly install on a standard shop vise and allow that vise to augment and increase the capacity for the size of a work object that the standard vise can hold.

A. Introduction of the Problems Addressed

Auxiliary devices for most vises have traditionally been complex to install onto a base vise in order to modify the ability of the base vise to hold an object or work piece. Often these auxiliary mechanisms require extra hand tools to install and are limited in design to work only with a specific brand or type of vise. Likewise, the mechanisms have been specially designed for a "parent vise" and focused on one limited manufacturing need.

B. Prior Art

Historically, vises and auxiliary mechanisms for vises have been a part of the technology improvement as the industrialization of the United States evolved. Several devices have attempted to improve upon parts of the problems as stated. In use, the prior art devices were often complex, difficult to install and limited in use. The new Vise Mate addresses these limitations and provides a solution to the stated problems.

Examples of prior auxiliary mechanisms for vises begin with U.S. Pat. No. 81,764 issued to Fisher (1868). This teaches a pair of drop-on face plates that provide no more additional work space. The device is stated to protect the surface finish of the work piece. Another improvement for vises was issued to Bergh as a U.S. Pat. No. 99,626 (1870). It teaches a face plate composed of copper, yellow brass or other soft, pliable metal. Although easily installed, this device adds no additional clamping capacity for the base vise.

Other examples include a U.S. Pat. No. 530,733 issued to Tower (1894) which teaches a separate steel jaw from the forging of the base vise. It uses a dovetail-like design as part of the attachment, but does not increase the capacity of the base vise. A U.S. Pat. No. 800,685 issued to Scoggins (1905) teaches a holder with an increased work piece capacity. It is held by fasteners requiring extra tools and is very narrow in its application to drill presses and the like.

A work holder face mechanism in U.S. Pat. No. 2,378,543 was issued to Fest (1945) that teaches a long, elastic attachment for vises. It is easily installed but does not provide an increased capacity.

A vise mechanism is taught in U.S. Pat. No. 2,606,470 issued to Kinney (1952). This tool shows a minimal increase to the capacity to hold a larger work piece. The prior art requires multiple fasteners and tools to install the device. A U.S. Pat. No. 3,502,319 issued toe Kazolias (1970) was focused at machining vises and not standard shop vises. It teaches parallel means for holding work pieces securely in a milling machine or the like. It shows no appreciable flexibility for use with standard shop vises and no increased work piece capacity. Range jaws for milling machines are similarly taught in a pair of patents. The U.S. Pat. No. 4,078,782 issued to Carlson (1978) and the U.S. Pat. No. 4,422,629 issued to Carlson (1983) both teach increases to the machine holding capacity, but both require tools and extra fasteners to attach the devices.

A slip-on jaw device is taught in U.S. Pat. No. 4,437,654 issued to Chiappetti (1984). This tool easily installs but provides no expanded jaw capacity for the base vise. A pair of extender jaws are taught by a U.S. Pat. Des. No. 292,481 issued to Wolff (1987). These increase the capacity for the work piece but require pins or fasteners to install. The stability of the work piece is not addressed and can not be ascertained from the ornamentation depicted.

A recent device for vise jaws is taught in U.S. Pat. No. 6,170,813 B1 issued to Bowers (2001). This device requires installation tools, fasteners, and extra inserts. It reduces the capacity of the base vise. None of the prior art teaches all the features and capabilities of the Vise Mate.

SUMMARY OF THE INVENTION

This is an auxiliary mechanism for a vise called a Vise Mate. This device features extender jaws to enable a person to hold larger than normal objects in a common shop vise. These extender jaws featured with a stabilizer bar permit a person to quickly expand the physical capacity of the shop vise with only the auxiliary vise mate and no additional set-up tools.

The newly invented device features very few parts. It is comprised of two extender jaws, a stabilizing bar and a method for fastening the bar to one of the extender jaws. The bar is attached to one jaw and is held in the other jaw by way of a dovetail-like slot and other retainer features described in detail below. The entire device is set onto the existing standard vise, without additional fasteners or tools, and physically extends the capacity of that standard vise.

OBJECTS AND ADVANTAGES

Accordingly, there are several objects and advantages of the VISE MATE. There currently exist intricate mechanisms for vises and other work holding devices that are made specifically for one type of vise. This Vise Mate provides an improvement because it is designed to be used with a wide variety of the most common shop vises in home shops as well as in commercial and industrial settings.

Another improvement is the set-up features of this device. The features enable a person, without the use of other tools, to quickly place the auxiliary device on the standard vise and to expand the physical capacity of the standard vise rapidly and efficiently.

This new device satisfies a long felt need to have an auxiliary device that could expand a smaller without requiring a person to obtain a larger, more expensive vise.

A further improvement is the use of the same simply designed part multiple times. The two extender jaws are of the same design, the stabilizing bar can be comprised of common material and dimensions, and the method to fasten can be one of several common fasteners. This combination provides an inexpensive and simple device to manufacture.

Another feature is provided. The device is compact and easily stored in a shop environment by use of an aperture at the end of the bar.

Another improvement is whereby the faces of the extender jaws feature a rough surface. This surface improves the ability to "grip" objects of irregular configurations or surface finishes.

Finally, other advantages and additional features of the present vise mate will be more apparent from the accompanying drawings and from the full description of the device. For one skilled in the art of devices and improvements for vises it is readily understood that the features shown in the examples with this mechanism are readily adapted to other types of shop vise improvements.

DESCRIPTION OF THE DRAWINGS—FIGURES

The accompanying drawings, which are incorporated in and constitute a part of this specification, illustrate an embodiment of the vise mate that is preferred. The drawings together with the summary description given above and a detailed description given below serve to explain the principles of the Vise Mate. It is understood, however, that the vise mate is not limited to only the precise arrangements and instrumentalities shown.

FIG. 4A is the Top View of an Extender Jaw.

FIG. 4B is the Front View of an Extender Jaw.

FIG. 4C is an End View of an Extender Jaw.

FIG. 4D is a Section View A—A of an Extender Jaw.

FIG. 5A is the Bottom View of an Extender Jaw.

FIG. 5B is the Back View of an Extender Jaw.

FIG. 5C is another End View of an Extender Jaw.

FIG. 5D is the Repeated Section View A—A of an Extender Jaw.

Figure 1:
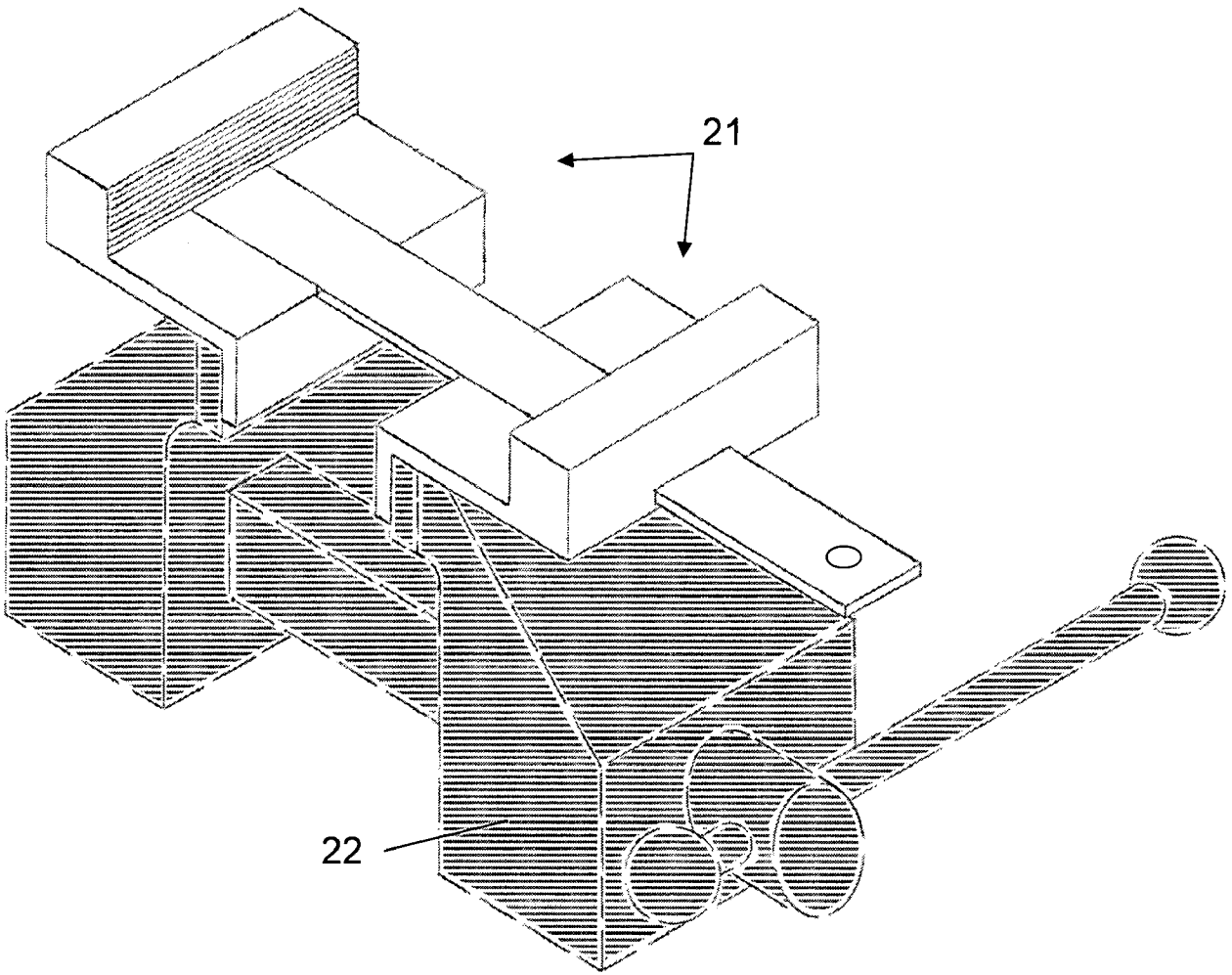
FIG. 1 is an Isometric View of the Vise Mate affixed onto a standard shop vise.

FIGS. 7A, 7B, and 7C are views demonstrating the operation of the present Vise Mate and a standard shop vise in respect to holding various sized work pieces.

DESCRIPTION OF THE DRAWINGS—REFERENCE NUMERALS

The following list refers to the drawings:

21 vise mate
22 standard shop vise
23 illustrated shop vise
24 extender jaws
25 roughened area
26 stabilizing bar
27 aperture
28 slot
29 relief area
30 aperture for fastening
31 lipped area
32 opening through jaws
33 transition areas
34 fastener
35 recessed area
36 work piece
37 larger work piece

DETAILED DESCRIPTION OF PREFERRED EMBODIMENT

The present device is an auxiliary mechanism for a vise called a Vise Mate. This mechanism is comprised of extender and a stabilizer bar, both having various features. A person having ordinary skill in the field of vises appreciates the various parts that may be used to physically permit this auxiliary vise extension device to be produced and utilized. The improvement over the existing art is providing a device that may be used with many common shop vises that are already on the market; a device that is simple and inexpensive to manufacture; a device that can eliminate or minimize the need to obtain a larger vise; a device that has fewer and more simply designed parts when compared to complex vise extension devices and work holders; a device that is compact; and, a device that has a provision to grip objects in a superior manner There is shown in FIGS. 1–7 a complete operative embodiment of the Vise Mate. The Vise Mate generally relates an auxiliary device for extending the physical capacity of the jaws in a common shop vise.

In the drawings and illustrations, note well that the FIGS. 1–7 demonstrate the general condition of having two extension jaws with the same functional features for each Vise Mate. For simplicity, it is understood that in the descriptions, below, only one jaw will normally be referenced.

The preferred embodiment of the device is comprised of only a few parts as shown in FIG. 1–7 of the drawings. These parts include, but are not limited to, two extender jaws 24, a stabilizing bar 26 and a fastener 34 or way to fasten the bar to one of the jaws. Various important features of these four (4) pieces are delineated in FIG. 1–7 of the drawings and are described below in appropriate detail for one skilled in the art to appreciate their importance and functionality to the Vise Mate.

FIG. 1 is an Isometric View of the Vise Mate 21 affixed onto a standard shop vise 22. The general Vise Mate 21 is indicated as setting on top of and contiguous to a typical, common shop vise 22. Note well that there are no fastening devices coupling the Vise Mate 21 and the common shop vise 22.

Figure 2:
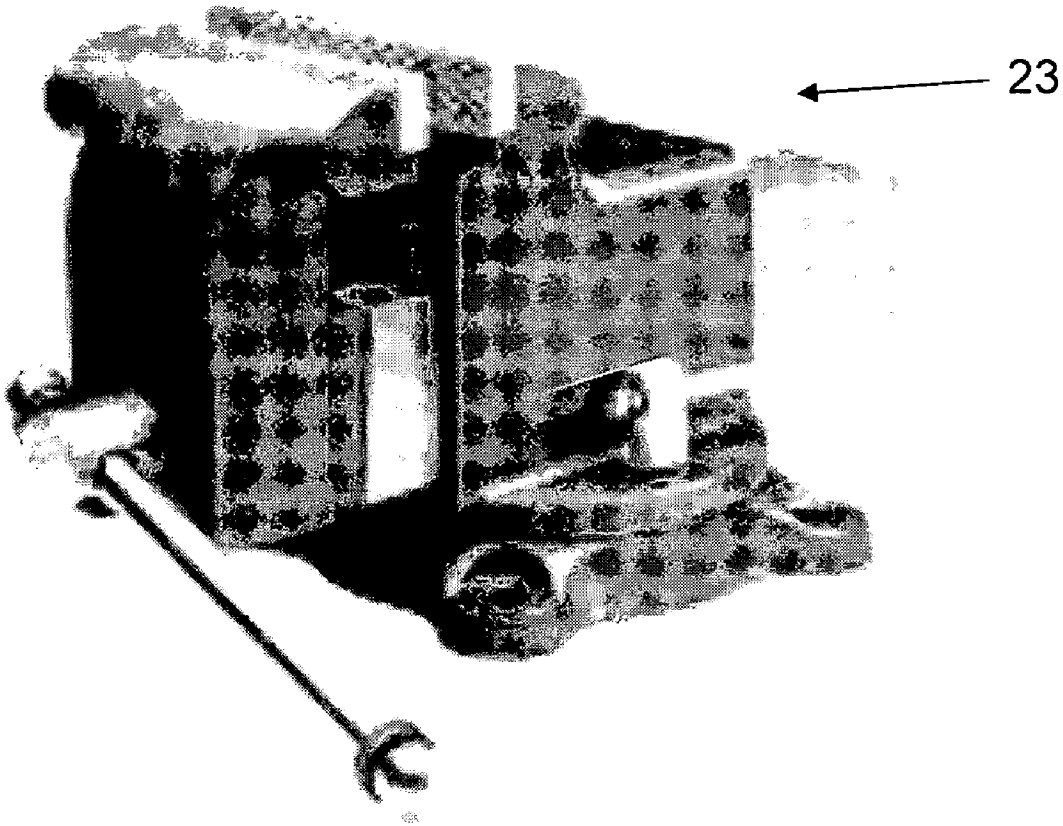
FIG. 2 is one example of a plethora of common shop vises.

FIG. 2 is an illustration 23 of a shop vise as one example of a plethora of common shop vises. The example is not shown to limit the use or expanse of the present device. The illustration 23 is shown as one of the many common shop vises currently used in workshops, at home or elsewhere, that are readily available in the marketplace.

Figure 3:
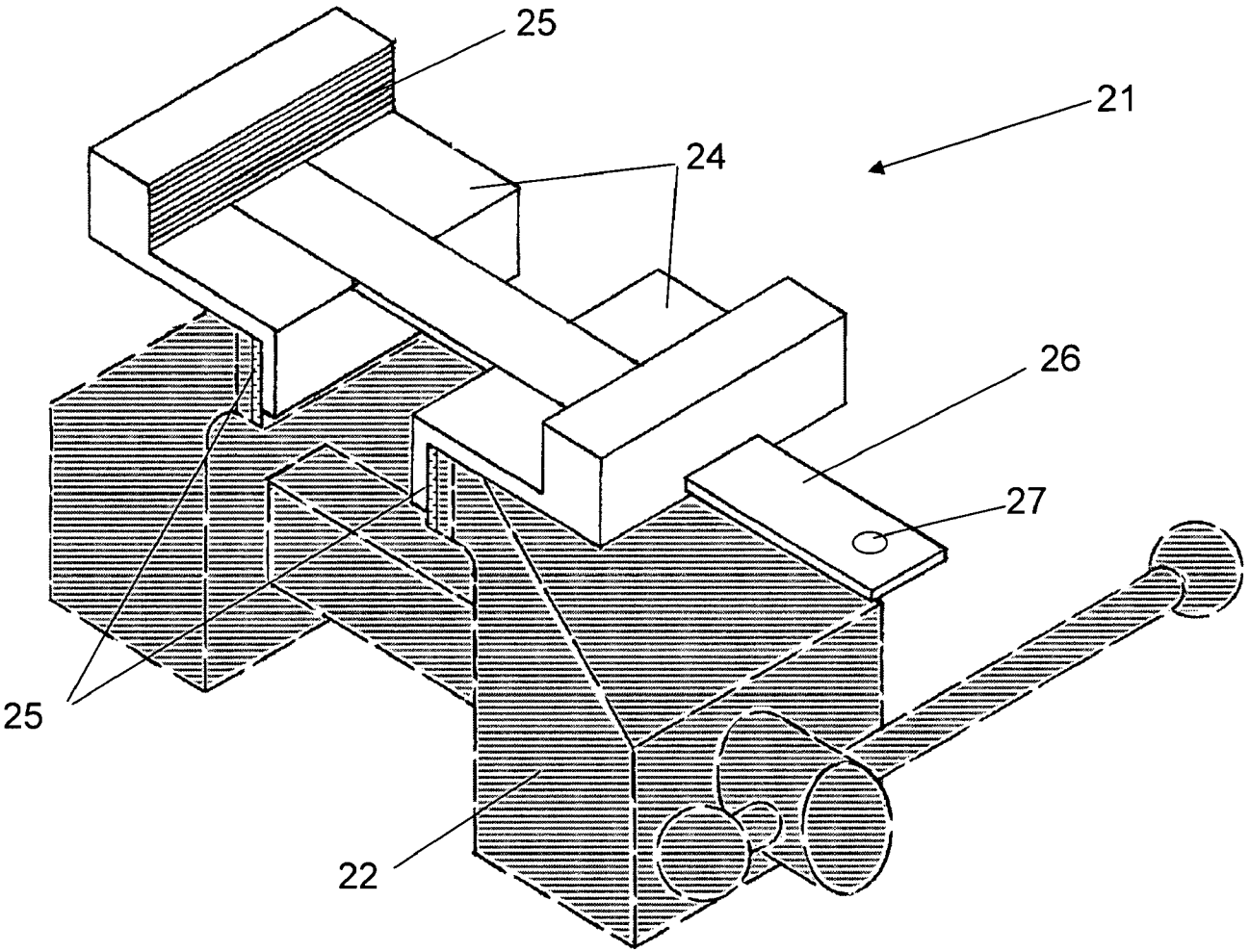
FIG. 3 is a repeat view of FIG. 1 with several of the elements and features of the elements indicated for further reference.

FIG. 3 is a repeat view of FIG. 1 with several more of the elements and features of the elements indicated for further reference. The Vise Mate 1 is comprised of two (2) identical extender jaws 24 with an essentially "Z" shaped cross section; a stabilizing bar 26 that is rigidly and securely connected to one of the jaws 24 and is free to slide in a controlled manner with the other jaw 24; and, a way to securely fasten the stabilizing bar 26 to the referenced extender jaw 24.

The jaws 24 are comprised of cast, forged or machined metal; plastics; composite materials; or some other material capable of providing rigid members comparable in strength to the common shop vise 22 that is being extended. Similarly, the stabilizing bar 26 is made of a metal, plastic, composite material, or some other like material that permits minimal flexing in the horizontal plane between the jaws 24. The material must permit the bar 26 to be rigidly connected to one jaw 24 and to maintain a uniform cross-section to permit and enable the bar 26 to slide in the other jaw 24.

Note a feature of each jaw 24 is the roughened area 25 on the face of the jaw. The roughened area 25 may be comprised of a cross hatched knurled surface, a grooved series of notches or some other way to provide a rough surface that is integral to the jaw 24. As an alternative, the area 5 may be achieved by some way whereby a rough surface is attached by a fastening or an adhesive manner to the surface of the extender jaw 24. See FIG. 26 below for additional details.

Note a feature on the stabilizing bar 26 is an opening or aperture 27. This aperture 27 provides at least two distinct functions. One function provides a location for securely connecting the bar 26 to one of the extender jaws 24. The other function may serve a purpose to enable the device to be stored (for example hung from a peg board or other fastener) when the Vise Mate 21 is not in use.

Figure 4:
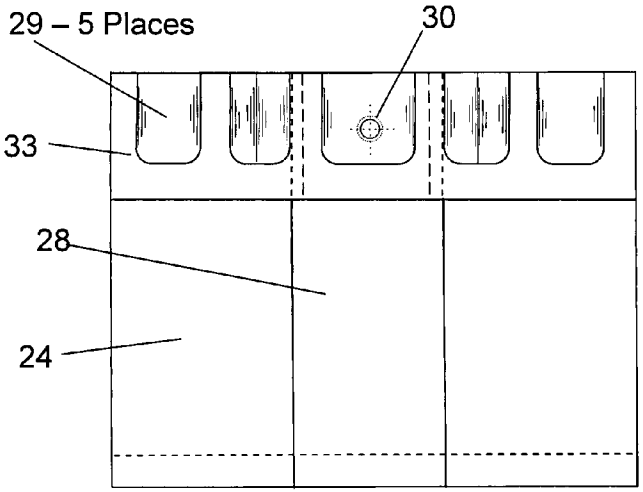
FIG. 4 is a group of views originating from a Top View of a single Extender Jaw.
Figure 4:
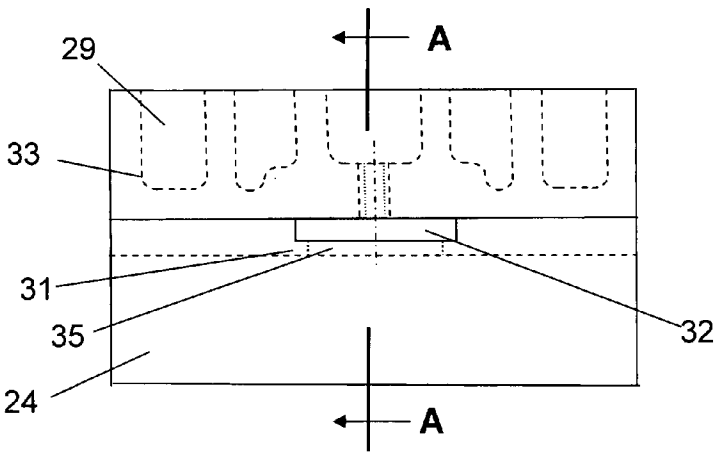
Figure 4:
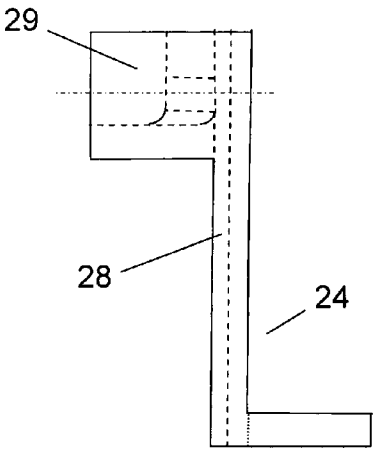
Figure 4:
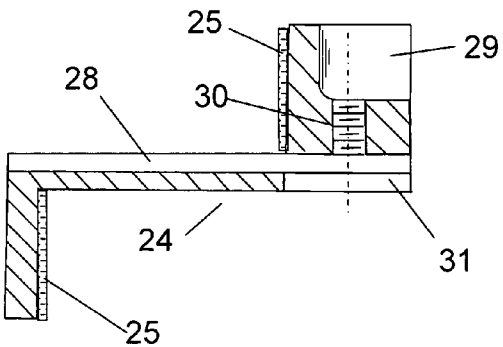

FIG. 4 is a group of views originating from a Top View of a single Extender Jaw 24. In FIG. 4A, the Top View of an Extender Jaw, additional features of an extender jaw 24 are delineated. There is a slot 28 that is machined, cast or molded into the jaw 24. This provides a way to control the stabilizing bar 26 as the shop vise 22 (not shown in this view) is opened and the one end of the bar 26 slides through the opposite jaw 24. All the views in FIG. 4 show the relief areas 29. There are five (5) relief areas 29 illustrated for example. This is not meant to limit fewer or additional relief areas. These relief areas 29 provide economy of material and strength to the overall extender jaws 24.

FIG. 4A and FIG. 4D both indicate that each extender jaw 24 has an aperture 30. This aperture 30 may be a cast or molded opening for a self tapping fastener; it may be a drilled and tapped opening; or it may be another way to provide a place to connect the stabilizing bar 26 to one of the extender jaws 24.

FIG. 4B and FIG. 4D both indicate that each extender jaw 24 has a lipped area 31 that is integral to the jaws 24. The lipped area 31 is a natural occurrence between the extension of the slide area provided by slot 28 and the recessed area 35 that is shown generally in FIGS. 4 and 5. This lipped area 31 is intended to prevent the unintended dislodgement of the stabilizing bar 26 from the one extender jaw 24 that is not rigidly fastened to the bar 26. The aforementioned recessed area 35 provides clearance area in the jaw 24 to enable the connection of the bar 26 to one of the extender jaws.

FIG. 4A is a Front View A—A of an Extender Jaw 24. It delineates, among the other features of an extender jaw 24, the opening 32 that extends through the jaws 24 where the bar 26 may slide in the non-connected jaw 24 and where the bar 26 may extend through to the fastening area 35 in the connected jaw 24.

Figure 5:
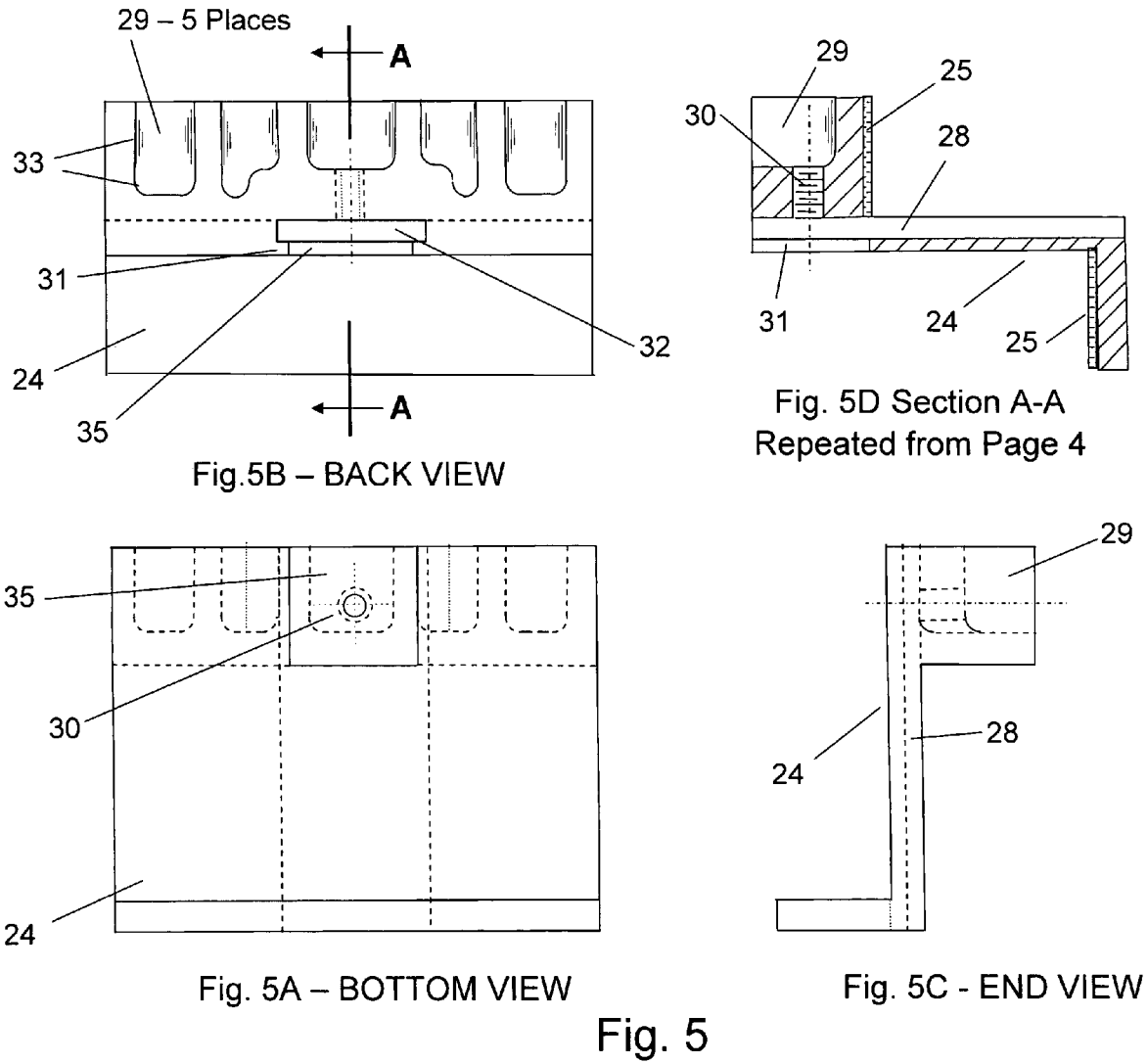
FIG. 5 is a group of views originating from a Bottom View of a single Extender Jaw.
Figure 6:
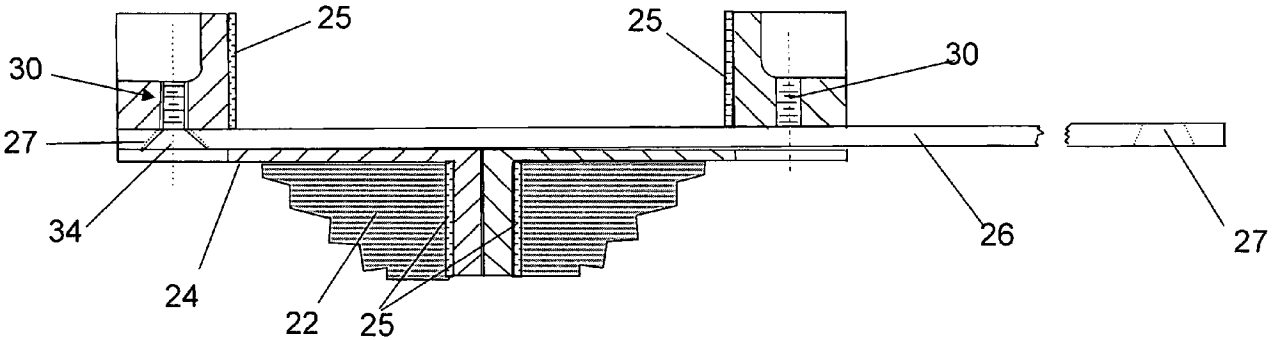
FIG. 6A is a Bottom View of the Vise Mate showing of its parts.
FIG. 6B is a Section View B—B of the Vise Mate wing the relationship of various parts and features.
Figure 6:
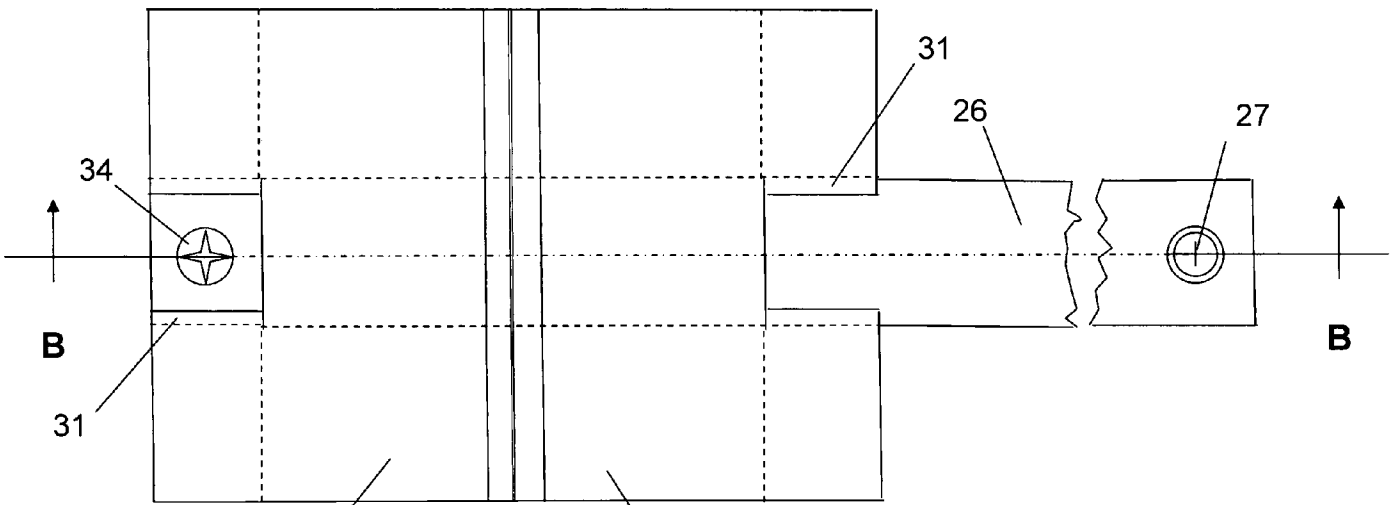

In both FIGS. 4 and 5 there are transition areas 33 shown in the various relief areas 29. These transition areas provide a manner to enable easier casting or molding in the manufacture of the jaws 24. In all cases—molded, cast, machined or other manufacturing processes, the smooth transition areas 33 provide stress relief to the extender jaws 24.

FIG. 5 is a group of views originating from a Bottom View of a single Extender Jaw 24. They contain the same elements as described above for FIG. 4. However, the views depict other surfaces of the extender jaws 24, namely the Bottom View on FIG. 5A, the Back View in FIG. 5B and another End View in FIG. 5C.

FIG. 6A is a Bottom View and FIG. 6B is a Cross section of the entire Vise Mate showing its parts. Note that the stabilizing bar 26 is of sufficient length to permit the full engagement of both extender jaws in the fully opened and fully closed position. This will vary for vises that have four (4), six (6) or eight (8) inch openings for the standard vise. However, the principal can be well understood by one skilled in the mechanical functions of this art.

The aperture 27 and the fastener 34 can be of various designs and cross-sections. Some examples, offered to enlighten and not limit the present embodiment, are flat head, pan head, round head, and interior or exterior hex head bolts. These would require a drilled and tapped or cast/molded insert as depicted as aperture 27. Likewise, a self tapping device might be utilized for fastener 34 to enable the aperture 27 to be a properly sized cast or molded opening for the fastener.

The rough area 25 depicted provides a cross section view. This demonstrates that the rough area 25 could be integral to the jaw 24 or could be fastened later to the surface of the jaw by an adhesive or other fastening way to rigidly connect it to the jaw 24 surface.

FIGS. 7A, 7B, and 7C are views demonstrating the operation of the Vise Mate and a standard shop vise 22 in respect to holding various sized work pieces. In FIG. 7A, a standard shop vise 22 is shown in an open position, holding or securing a work piece 36. In FIG. 7B, the same standard vise 2 has the Vise Mate 21 installed. The standard vise is in the closed position, but is able to still hold a work piece 36. The Vise Mate 21 components and features act to stabilize the interaction of the Vise Mate 21 and standard vise 22. The stabilizing bar 6 extends through the extender jaw 24 in opening 32. The bar 26 is prevented from unintentional dislodgment by the lipped area 31. In FIG. 7C, the standard vise 2 jaws are fully opened. The Vise Mate 21 now holds and secures a much larger work piece 37. The stabilizing bar 36 is still prevented from dislodgement by the actions describe above for the opening 32 and lipped area 31.

The details mentioned here are exemplary and not limiting. Other components specific to describing an auxiliary extension device for a vise may be added as a person having ordinary skill in the field of vises well appreciates.

OPERATION OF THE PREFERRED EMBODIMENT

The new auxiliary mechanism for a vise as the present Vise Mate has been described in the above embodiment. The manner of how the device operates is described below. Note well that the description above and the operation described here must be taken together to fully illustrate the concept of the Vise Mate.

The embodiment described above is essentially an auxiliary mechanism for a vise with improvements and new parts. The added parts include, but are not limited to, a set of extender jaws 24; a stabilizing bar 26; and, a fastener 34 or way to fasten one end of the stabilizing bar 26 to one of the extender jaws 24. These components parts of the auxiliary mechanism interact with each other and with the standard shop vise 22 to result in the extension of the physical capacity of a standard shop vise 22. In other words, the standard shop vise 22, by way of the essentially Z-shaped extender jaws 24, can now "hold" a much larger work piece. See FIG. 7. This interaction provides an operation of the device that is more simple and easier to use with respect to the operation of other, more complex designs of jaw extensions and work holders for standard and specially designed vises.

The interaction of all the new auxiliary component parts and the standard shop vise 22 is summarized as follows: The jaw extenders 24 and the stabilizing bar 26, once fastened securely to one of the jaws 24 by some manner such as a fastener 34, comprise the Vise Mate 21. The Vise Mate 21 physically rests on top of a standard vise 22 as shown in FIGS. 1, 3, 6B and 7. Therefore, no set-up tools are required to extend the physical capacity.

Figure 7:
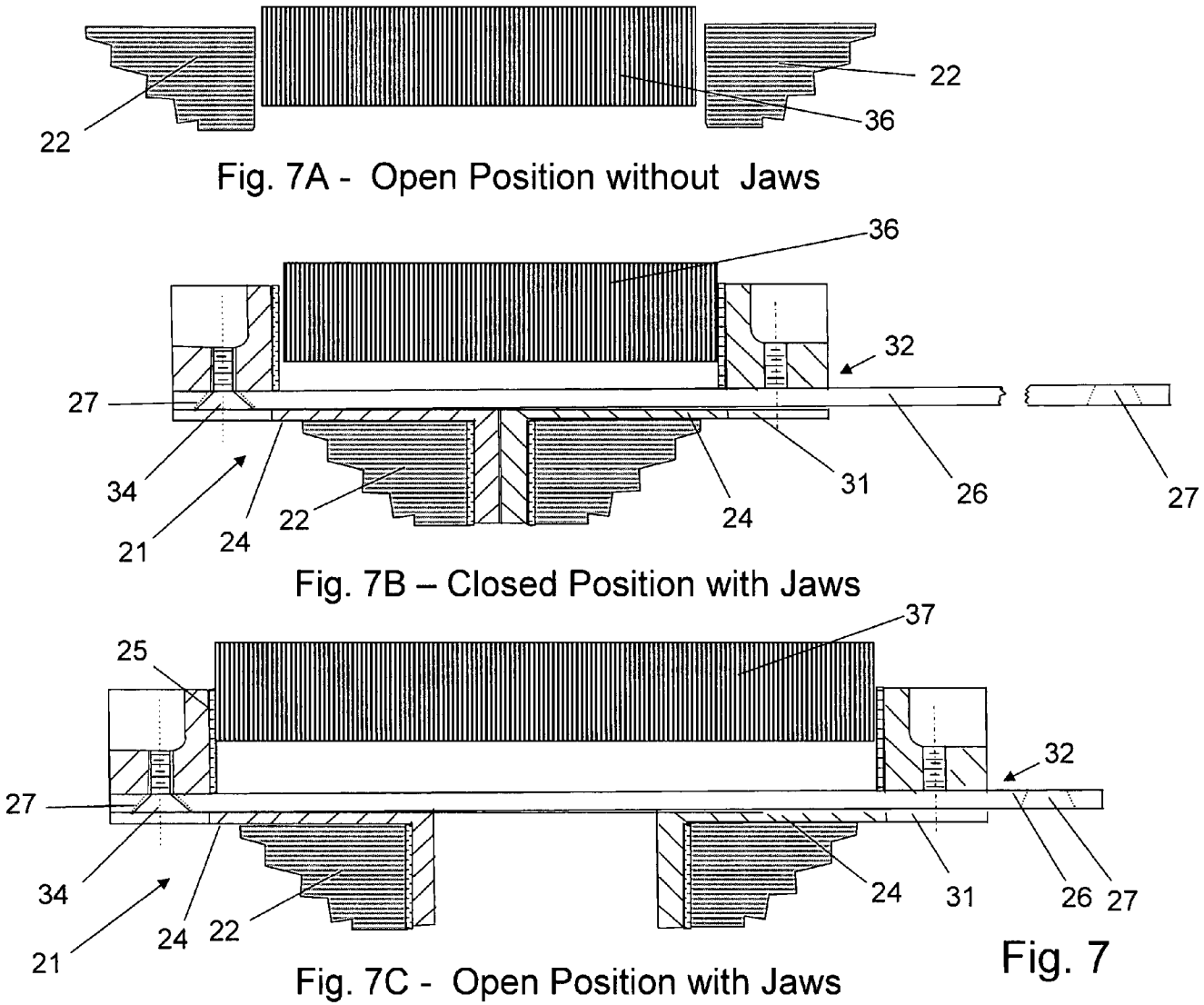

The Vise Mate 21 can extend out or slide apart inside of the standard vise 22 thereby opening the physical capacity of the jaws as shown in FIG. 7. Normally, a fully extended standard vise 22 would hold a work piece 36 of a given size. See FIG. 7A. With the Vise Mate 21, that physical capacity is enlarged. As the standard shop vise 22 closes on the Vise Mate 21, the extender jaws 24 are held together by virtue of the stabilizing bar 26. This is because the bar 26 is attached securely to one of the extender jaws 24 and rests in the slot 28 of each of the extender jaws 24. Importantly, the sliding end of the stabilizing bar 26 extends through the free jaw at the opening 32 and continues inside the lipped area 31. This prevents unintentional dislodgment of the stabilizing bar 36 and any inward "tipping" of the extender jaws 24 as they are closed between the normal jaws of the standard vise 22. See FIG. 7B for the closed position. With the extender jaws 24 in place, one can see that in the closed position, the standard vise 22 and the extender jaws 24 can still hold essentially the same sized work piece 36. However, as the standard vise 22 jaws are opened, the extender jaws 24 permit a much larger work piece 37 to be held by the interaction of the standard vise 22 and the Vise Mate 21. This is fully demonstrated in FIGS. 7A, 7B, and 7C.

With this description it is to be understood that the Vise Mate is not to be limited to the disclosed embodiment. For instance, this same concept applies to four, six, and eight inch (or larger) standard vises. The features of the Vise Mate are intended to cover various modifications and equivalent arrangements included within the spirit and scope of the description.

What is claimed as new and desired to be protected by Letters Patent is:

1. An auxiliary device for use with a base vise for increasing capacity of the vise for holding a work piece, comprising:

(a) a set of extender jaws which have been configured with top flanges that have a plurality of slots manufactured therein and the extender jaws are configured to operatively attach to the base vise;

(b) a single stabilizer bar; and (c) a means for connecting the stabilizer bar to the extender jaws whereby the device is installable to the base vise without tools and fasteners and the plurality of slots provide the extender jaws with less mass and at least equal structural strength as compared to a solid top flange.

2. An auxiliary device for use with a base vise for increasing capacity of the vise for holding a work piece, comprising:

(a) a set of extender jaws which have been configured with top flanges that have five irregularly shaped slots manufactured therein and the extender jaws are configured to operatively attach to the base vise;

(b) a single stabilizer bar; and (c) a means for connecting the stabilizer bar to the extender jaws whereby the device is installable to the base vise without tools and fasteners and the five slots provide the extender jaw with less mass and at least equal structural strength as compared to a solid top flange.

* * * * *